US006134332A

United States Patent [19]

Wiener

[11] Patent Number: 6,134,332

[45] Date of Patent: Oct. 17, 2000

[54] SOUND LENS SPEAKER SYSTEM

[76] Inventor: David Wiener, 10 Iron Canyon Ct., Park City, Utah 84060

[21] Appl. No.: 08/982,066

[22] Filed: Dec. 1, 1997

Related U.S. Application Data

[63] Continuation-in-part of application No. 08/857,351, May 16, 1997, Pat. No. 6,031,920.

[51] Int. Cl.[7] ..... H04R 25/00

[52] U.S. Cl. ..... 381/160; 381/182; 381/186; 381/387; 181/155

[58] Field of Search ..... 381/300, 87, 89, 381/332, 160, 182, 186, 386, 387, 337; 181/144, 145, 147, 152, 153, 155, 156, 199

[56] References Cited

U.S. PATENT DOCUMENTS

| | | | |
|---|---|---|---|
| 1,120,858 | 12/1914 | Stallforth | 181/30 |
| 2,228,024 | 1/1941 | Abrahams | 181/26 |
| 2,643,727 | 6/1953 | Leon | 181/31 |
| 3,065,816 | 11/1962 | Ranger | 381/336 |
| 3,647,284 | 3/1972 | Elings et al. | 350/294 |
| 3,776,361 | 12/1973 | Rolle | 181/0.5 A |
| 3,832,888 | 9/1974 | Langlois | 73/67.5 H |
| 3,895,188 | 7/1975 | Ingraham | 179/1 MF |
| 3,908,095 | 9/1975 | Jinsenji | 179/102 |
| 4,421,200 | 12/1983 | Ferralli et al. | 181/144 |
| 4,524,846 | 6/1985 | Whitby | 181/152 |
| 4,629,030 | 12/1986 | Ferralli | 181/155 |
| 4,801,941 | 1/1989 | Sabet-Peyman | 342/378 |
| 4,836,328 | 6/1989 | Ferralli | 181/155 |
| 4,876,723 | 10/1989 | Fang | 381/182 |
| 4,964,100 | 10/1990 | Srour et al. | 367/178 |
| 4,965,837 | 10/1990 | Murayama et al. | 381/186 |
| 4,967,873 | 11/1990 | Hacchow et al. | 181/176 |
| 5,033,456 | 7/1991 | Pell et al. | 128/24 EL |
| 5,050,436 | 9/1991 | Kunii et al. | 73/644 |
| 5,199,075 | 3/1993 | Fosgate | 381/24 |
| 5,220,608 | 6/1993 | Pfister | 381/17 |
| 5,268,539 | 12/1993 | Ono | 181/155 |
| 5,532,438 | 7/1996 | Brown | 181/155 |
| 5,673,329 | 9/1997 | Wiener | 381/160 |
| 6,031,920 | 2/2000 | Wiener | 381/160 |

FOREIGN PATENT DOCUMENTS

| | | | |
|---|---|---|---|
| 0 500 294 A2 | 8/1992 | European Pat. Off. | H04R 5/02 |
| 3902062A1 | 1/1989 | Germany | H04R 1/34 |
| 0291798 | 12/1990 | Japan | 381/160 |
| 4247171 | 1/1991 | Japan . | |

OTHER PUBLICATIONS

Secret Sound®– The Unique Directional Speaker System sales brochure from Museum Tools, at least as early as Apr. 1991.

*Primary Examiner*—Huyen Le

*Attorney, Agent, or Firm*—David P. Gordon; David S. Jacobson; Thomas A. Gallagher

[57] ABSTRACT

A sound lens speaker system includes a concave sound lens, two upper frequency drivers, and a lower mid/low frequency driver. The mid/low frequency driver is oriented to fire sound waves towards the apex of the sound lens. The two high frequency drivers are positioned off axis between the mid/low frequency driver and the apex of the sound lens, and are preferably angled toward the apex of the sound lens. Sound waves from the high frequency drivers and mid/low driver are reflected by the sound lens into a downward substantially focused beam of full frequency spectrum sound. In a preferred embodiment, the sound lens has an upper parabolic portion and a coaxial lower parabolic portion defined by different parabolic equations and each having a respective focus. The high frequency drivers are preferably located along an arc through the upper focus and the mid/low frequency driver is substantially vertically aligned with the lower focus.

26 Claims, 3 Drawing Sheets

SOUND LENS SPEAKER SYSTEM

This application is a continuation-in-part of Ser. No. 08/857,351, filed on May 16, 1997, now U.S. Pat. No. 6,031,920 which is hereby incorporated by reference herein in its entirety.

BACKGROUND OF THE INVENTION

1. Field of the Invention

This invention relates broadly to audio speaker systems. More particularly, this invention relates to an audio speaker system having a sound lens.

2. State of the Art

A number of speaker systems are known for focusing sound. Sound focusing speakers use a concave lens and a speaker directed into the concave lens. Ideally, the lens reflects sound from the speaker such that the sound reflected is confined to a desired area. These speaker systems have particular application where it is desired to prevent sound emitted by one speaker system from interfering with sound emitted by another speaker system. In addition, these speaker systems are useful for "listening stations" where it is desired that only listeners at a "listening station" be able to hear the sound from the speaker system.

U.S. Pat. No. 5,268,539 to Ono discloses a partial ellipsoid sound lens having a speaker at one focus of the lens. Proper placement of the speaker system at one focus results in the sound being reflected by the lens and focusing at the second focus of the ellipse, where the listener is positioned. Unless a listener has his or her ears located at the second focus, listening will not be optimal. In addition, because sound is reflected back toward the second focus from many angles, sound will overshoot the second focus, and failing to be contained, will strike floor surfaces and disperse. The dispersion of sound will provide auditory interference to others in the vicinity of the ellipsoid sound lens.

U.S. Pat. No. 5,532,438 to Brown discloses a sound lens speaker system similar to the Ono system. The Brown system includes a spherical dome and left and right channel speakers (each speaker reproducing the same frequency range) directed into the dome. The speakers are oriented such that sound from the speaker reflects off the inside of the dome and is purportedly focused in stereo at the listeners ears. The Brown system suffers from the same drawbacks as the Ono system. The ears of the listener must be particularly positioned at a particular height relative to the dome to accurately hear the reflected sound. In addition, the speakers will cause sound to spill over outside the spherical dome. Furthermore, the spherical shape of the dome will likely further propagate uncontrolled sound scatter outside the dome.

Museum Tools of San Rafael, Calif., offers a sound lens speaker system under the name Secret Sound® which includes a parabolic sound lens and a speaker located at the focus of the parabolic lens. The speaker radiates sound upward into the sound lens and the sound lens then focuses the sound into a substantially vertical beam of sound, thereby reducing the amount of sound which is uncontrollably scattered. However, contrary to the Secret Sound® literature, the Secret Sound® sound lens is not designed to handle a full spectrum of humanly audible sound. The curvature and size of the parabolic lens is not optimized to accurately reflect both high and low frequency sound waves. Moreover, in each of the above speaker systems, the speakers are incapable of reproducing a broad spectrum of sound frequencies.

SUMMARY OF THE INVENTION

It is therefore an object of the invention to provide a focused sound lens speaker system having a speaker system designed to produce a broad spectrum of sound frequencies.

It is another object of the invention to provide a focused sound lens speaker system utilizing speakers which reproduce different ranges of sound frequencies.

It is also object of the invention to provide a focused sound lens speaker system having speakers relatively positioned for reproducing and focusing a broad frequency spectrum of sounds.

It is an additional objective to provide a focused sound lens speaker system having a sound lens designed to optimally, controllably reflect a broad spectrum of sound frequencies such that sound reflected by the lens is broad spectrum and confined to a relatively small area.

In accord with these objects which will be discussed in detail below, a sound lens speaker system is provided and includes a concave sound lens, two upper frequency drivers, and a lower mid/low frequency driver. The mid/low frequency driver is oriented to fire sound waves towards the apex of the sound lens. The two high frequency drivers are positioned off axis between the mid/low frequency driver and the apex of the sound lens and are preferably angled toward the apex of the sound lens. Sound waves from the high frequency drivers and mid/low driver are reflected by the sound lens into a focused beam of full frequency spectrum sound.

In a preferred embodiment, the sound lens has an upper parabolic portion and a coaxial lower parabolic portion defined by different parabolic equations and each having a respective focus, as is disclosed in parent application Ser. No. 08/857,351. The high frequency drivers are preferably located along an arc through the upper focus and the mid/low frequency driver is substantially vertically aligned with the lower focus.

The sound lens speaker system is optimized to accurately reproduce a broad frequency spectrum of sound and to reflect the sound into a substantially vertical beam. As a result, the sound focusing speaker system of the invention provides an optimal sound reproduction system where it is desirable to produce high quality sound and confine the sound to a relatively controlled vertical beam.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
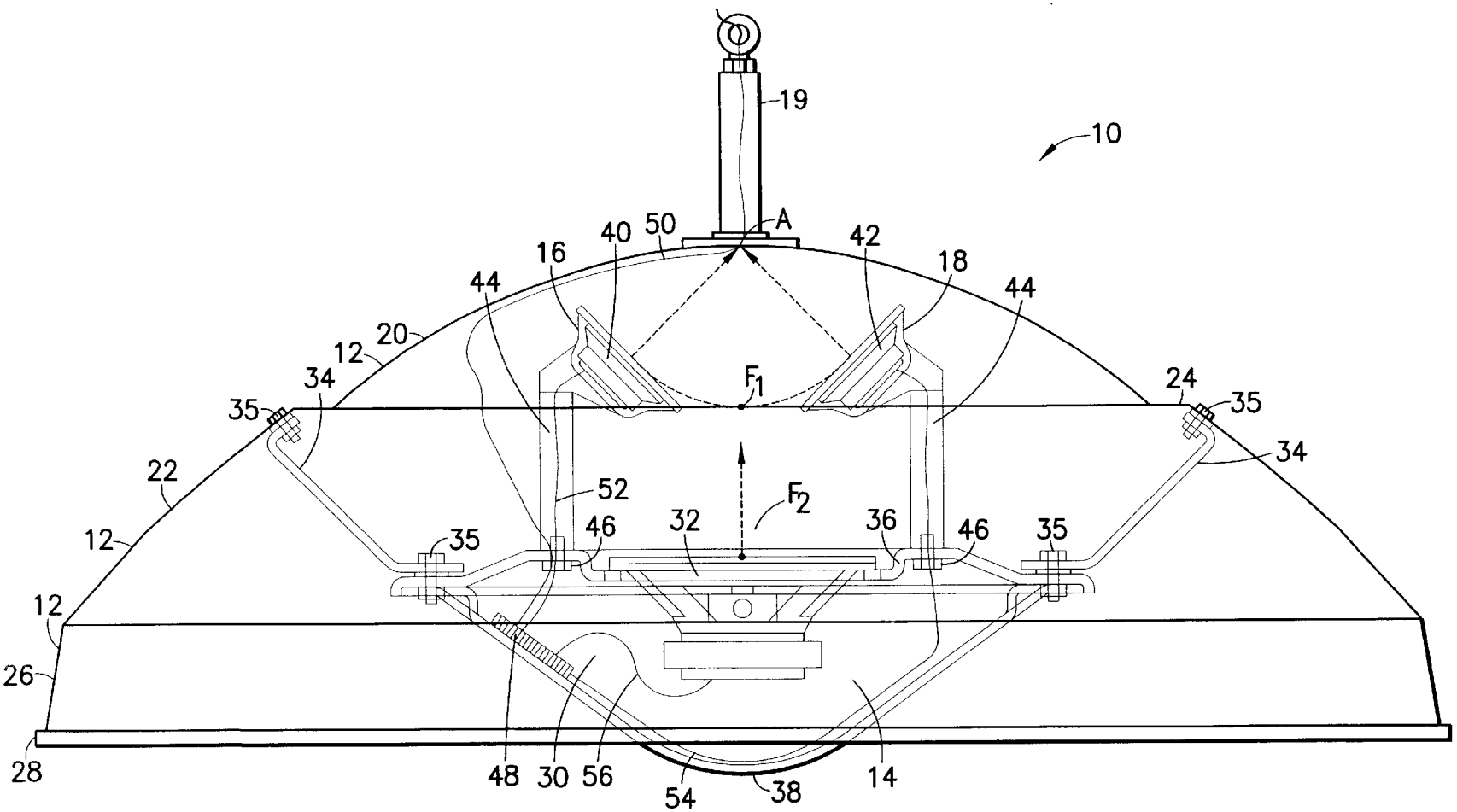
FIG. 1 is a transparent side elevation view of a sound lens speaker system according to a first embodiment of the invention.

Referring to FIG. 1, a sound focusing speaker system 10 according to a first preferred embodiment of the invention is shown. The sound focusing speaker system 10 generally includes a concave sound lens 12, preferably made from acrylic, a mid/low frequency speaker driver assembly 14 residing partially inside the space defined by the sound lens and preferably two relatively high frequency speaker drivers assemblies 16, 18 residing completely inside the space defined by the sound lens.

According to the preferred embodiment of the invention, the sound lens 12 has an upper parabolic portion 20 and a coaxial lower parabolic portion 22. The upper and lower portions 20, 22 are defined by different parabolic equations, each having a focus, $F_1$ and $F_2$, respectively, such that a non-spherical contour is provided. The upper and lower parabolic portions preferably meet at a substantially planar and horizontal shelf 24. In a preferred embodiment, the shelf defines a plane which extends approximately through the focus $F_1$ of the upper parabola. Preferably, a conical skirt 26 is also provided adjacent the lower parabolic portion 22, and a lower lip 28 is provided around the conical skirt 26. According to the preferred embodiment of the invention, the upper parabolic portion 20 is optimized to reflect higher frequency sound waves, while the lower parabolic portion 22 is optimized to reflect relatively lower frequency sound waves, as described in detail in previously incorporated co-owned U.S. Ser. No. 08/857,351. A suspension mount 29 is preferably provided to the upper surface of the sound lens, preferably at the apex A, to permit the sound lens speaker system 10 to be suspended from a ceiling or other support structure.

According to a preferred aspect of the invention, the mid/low speaker driver assembly 14 includes a speaker enclosure 30 having a baffle 36 and a preferably concave rear wall 38, a mid/low speaker driver 32 mounted in the baffle 36, and mounting brackets 34 and hardware 35 (e.g., screws and nuts) for coupling the speaker enclosure 30 to the lower portion 22 of the sounds lens 12. The mid/low speaker driver 32 is oriented to fire sound waves towards the apex A of the sound lens 12 and preferably has its center positioned in vertical alignment with foci $F_1$ and $F_2$ and in horizontal alignment with focus $F_2$. According to the preferred embodiment, the concave rear wall 38 descends beyond the lower lip 28 of the sound lens 12.

Each of the two high frequency driver assemblies 16, 18 includes a high frequency driver (or tweeter) 40, 42 and mounting posts 44 and hardware 46 to mount the tweeters off-axis between the mid/low frequency driver 32 and the apex A of the sound lens. The mounting posts 44 and hardware 46 mount the tweeters 40, 42 to the baffle 30. The tweeters 40, 42 are preferably generally aligned with the focus $F_1$ of the upper parabolic portion 20. More particularly, the center of the tweeters 40, 42 are preferably located along an arc through the focus $F_1$ and are preferably angled toward the apex A of the sound lens. The tweeters 40, 42 are preferably positioned away from each other on either side of the focus $F_1$ and are angled approximately 45° relative to the horizontal.

A crossover circuit board 48 for sending audio signals to the appropriate speaker driver (i.e., high frequency signals to the tweeters 40, 42 and mid/low frequency signals to the mid/low speaker driver 32) is provided within the speaker enclosure 30. An audio signal input wire 50 runs through the suspension mount 29, enters the speaker enclosure 30, and is coupled to the crossover circuit board 48. Output wires 52, 54, 56 from the circuit board 48 respectively are provided to the tweeters 40, 42 and to the mid/low speaker driver 32.

In operation, sound from the speaker drivers 32, 40, 42 is directed upward toward the apex A, and is reflected by the sound lens 12 into a pseudo-columnar beam of sound waves. The upper and lower parabolic portions 20, 22, with respective upper and lower foci $F_1$, $F_2$, are designed to reflect the sound waves of the tweeters 40, 42 and mid/woofer driver 32, respectively. Particularly, the upper parabolic portion 20 is designed to reflect sound waves emitted by the tweeter drivers, while the lower parabolic portion is designed to have a relatively larger diameter, as a larger lower parabolic portion is better able to reflect and to contain lower frequency (and longer wavelength) sound waves. Experimental results have shown that the above described dual parabolic sound lens, a mid/low speaker driver positioned in vertical alignment with the two foci $F_1$, $F_2$ and in horizontal alignment with focus $F_2$, and two tweeters positioned along an arc through focus $F_1$ and angled at 45° toward the apex provides a focused "beam" of sound with constrained sound coverage and minimized undesirable sound leakage outside the footprint of the sound lens. Moreover, the focused "beam" of sound is of a high fidelity quality, providing a relatively flat response (e.g., ±3 dB) throughout a large frequency range.

Figure 2:
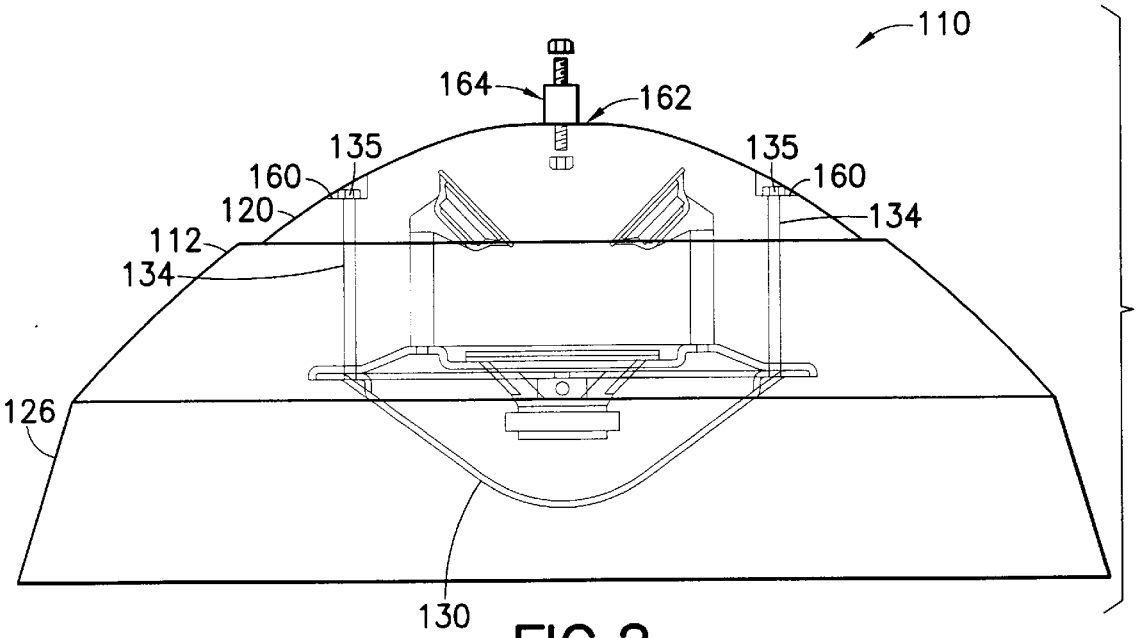
FIG. 2 is a transparent side elevation view of a sound lens speaker system according to a second embodiment of the invention.

Turning now to FIG. 2, according to a second embodiment of the sound lens speaker system 110, substantially similar to the first embodiment (with like parts having numbers incremented by 100), it will be appreciated that the speaker enclosure 130 may also be mounted to the upper portion 120 of the sound lens 112. The mounting hardware mechanism in the embodiment of FIG. 2 comprises rubber mounting rods 134 (or mounting brackets) and hardware 135. The sound lens 112 may be molded with flat areas or recesses 160 to assist the coupling of the mounting rods 134 and hardware 135 to the sound lens 112. The upper portion 120 of the sound lens may also be molded with a flattened apex region 162 and coupled to load spreading rubber "shock mount" washer 164 to prevent movement and reduce the risk of accidental cracking of the sound lens. In addition, the conical portion 126 of the sound lens may be extended beyond the speaker enclosure 130.

Figure 3:
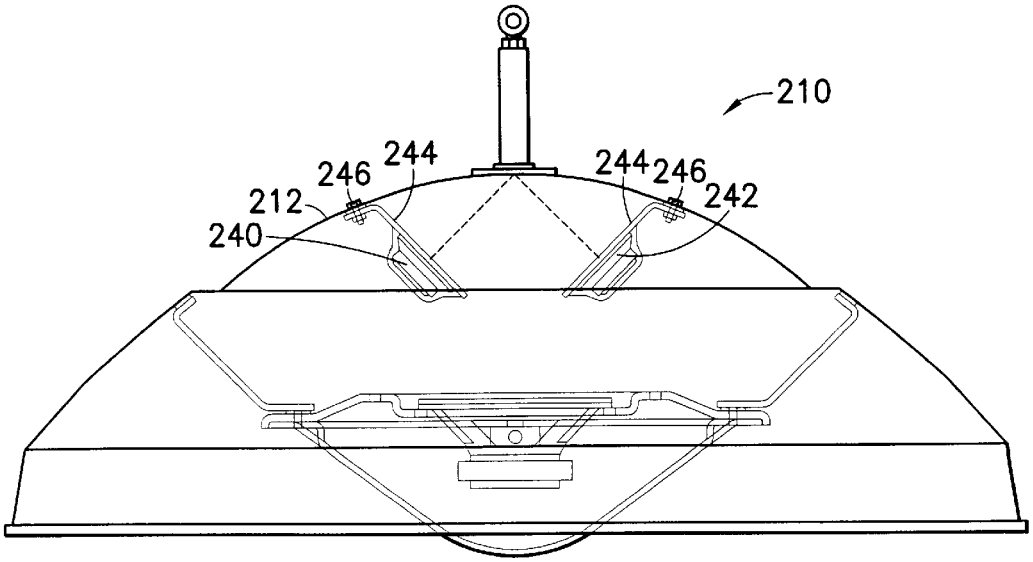
FIG. 3 is a transparent side elevation view of a sound lens speaker system according to a third embodiment of the invention.

Referring now to FIG. 3, according to a third embodiment of the sound lens speaker system 210, substantially similar to the first embodiment (with like parts having numbers incremented by 200), it will also be appreciated that the tweeters 240, 242 may be mounted directly to the sound lens 212 with mounting brackets 244 and hardware 246.

Figure 4:
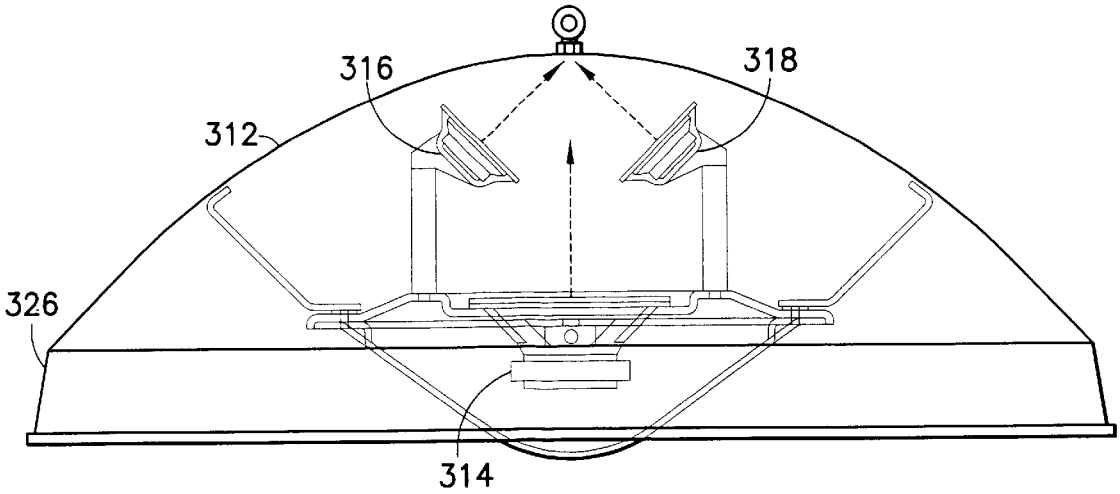
FIG. 4 is a transparent side elevation view of a sound lens speaker system according to a fourth embodiment of the invention.
Figure 5:
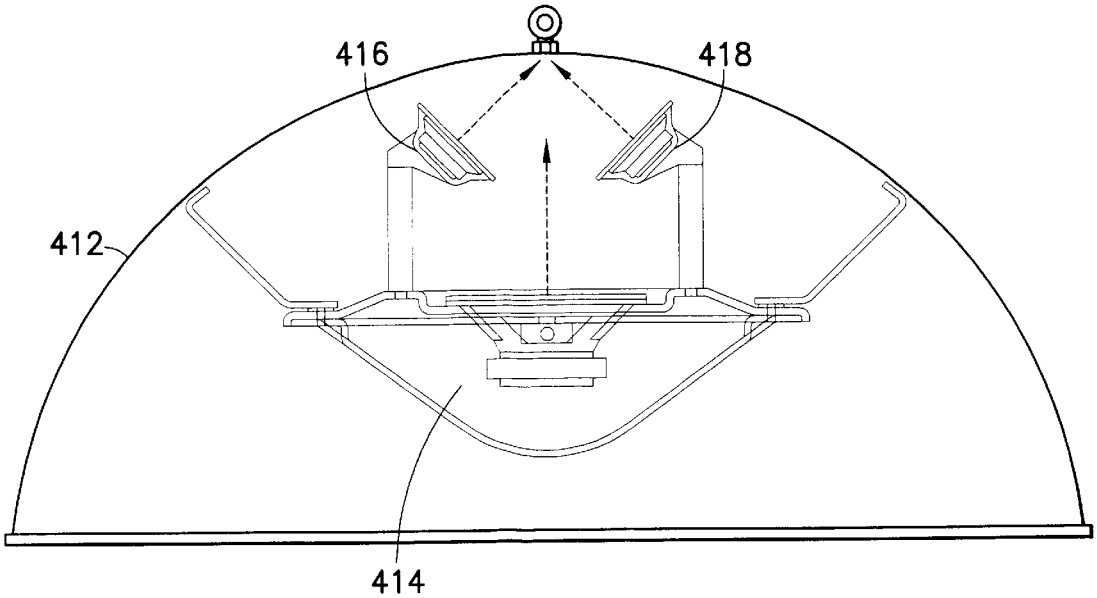
FIG. 5 is a transparent side elevation view of a sound lens speaker system according to a fifth embodiment of the invention.

While it is preferred that a dual parabolic sound lens be used in the sound lens speaker system, as described above, it will be appreciated that any concave dome-shaped sound lens may be used. For example, turning to FIG. 4, a single parabolic sound lens 312, preferably with a conical portion 326, may be used with a mid/low frequency driver assembly 314 and two high frequency driver assemblies 316, 318. By way of another example, referring to FIG. 5, a constant radius dome 414 may also be used with the mid/low frequency driver assembly 414 and the two high frequency driver assemblies 416, 418. When a non-parabolic sound lens is used, minor experimentation is required to vertically position the speaker driver assemblies within the sound lens such that the most accurate and focused sound is produced.

There have been described and illustrated herein several embodiments of a sound lens speaker system. While particular embodiments of the invention have been described, it is not intended that the invention be limited thereto, as it is intended that the invention be as broad in scope as the art will allow and that the specification be read likewise. Thus, while two high frequency driver assemblies have been disclosed, it will be appreciated that one or more than two high frequency driver assemblies may also be used. Furthermore, more than two frequency ranges may be sent to a respective number of driver systems, each having speakers for satisfactorily emitting sounds within the respective frequency range. In addition, while the tweeters have been shown as angled at preferably 45° toward the apex, it will be appreciated that the tweeters may be angled at other angles, though preferably between approximately 30°–60°. Moreover, while the center of the tweeters are preferably provided along an arc through the upper focus $F_1$ (in a dual parabolic sound lens), it will be appreciated that the tweeters may be elsewhere located above the mid/low frequency speaker driver assembly. Furthermore, while the mid/low frequency speaker driver is approximately vertically aligned with the lower focus $F_2$ (in a dual parabolic sound lens) it will be appreciated that the mid/low frequency speaker driver may be positioned otherwise. Also, while various sound lens shapes have been described, it will be appreciated that even other sound lens shapes may be used, e.g., a sound lens provided with three or more parabolic portions or an elliptical section. Furthermore, the mid/woofer pod may be provided with a port to extend low frequency dynamics. Also, while particular mounting hardware is disclosed for coupling the speaker driver assemblies to the sound lens, it will be recognized that other mounting hardware may used. In addition, while various embodiments describe a combination of features, it will be appreciated that the disclosure is intended to support various other combinations of features. For example, the sound lens as disclosed in the first embodiment with a conical skirt extending below the speaker enclosure. Moreover, while the term "vertical" has been used in the above description to indicate relative position and direction, it will be appreciated that the term should be construed broadly above and in the claims. That is, the dual-parabolic sound lens speaker system may be oriented off-axis by between 0° and 180°, and the relative position and orientation of components and focused sound waves will likewise be rotated by the same degree relative to their described position. It will therefore be appreciated by those skilled in the art that yet other modifications could be made to the provided invention without deviating from its spirit and scope as so claimed.

What is claimed is:

1. A sound focusing speaker system, comprising:

a) a concave dome-shaped sound lens defining a space;

b) at least one first speaker driver means for emitting sound waves of a first frequency range into said sound lens; and c) a second speaker driver assembly having a second driver means for emitting sound waves of a second frequency range into said sound lens, said second frequency range being different than said first frequency range, said at least one first driver means and said second driver means being directed into said sound lens from a concave side of said sound lens such that said sound waves of said first frequency range are substantially acoustically unobstructed between said at least one first driver means and said sound lens, and said at least one first driver means and said second driver means being at least partially within said space defined by said sound lens.

2. A sound focusing speaker system according to claim 1, further comprising:

d) first mounting means for mounting said at least one first speaker driver assembly to one of said sound lens and said second speaker driver assembly; and e) second mounting means for mounting said second speaker driver assembly to said sound lens.

3. A sound focusing speaker system according to claim 1, wherein:

said at least one first speaker driver means is located vertically between said second speaker driver assembly and said sound lens.

4. A sound focusing speaker system according to claim 1, wherein:

said concave sound lens has an apex, an upper parabolic portion defined by a first parabolic equation and having an upper focus, and a lower parabolic portion defined by a second parabolic equation and having a lower focus different than said upper focus.

5. A sound focusing speaker system according to claim 4, wherein:

said second speaker driver means being located substantially at said lower focus and directed at said apex.

6. A sound focusing speaker system according to claim 4, wherein:

said at least one first speaker driver means is exactly two first speaker driver means, each first speaker driver means being provided off-axis from a line segment from said apex to said upper focus.

7. A sound focusing speaker system according to claim 6, wherein:

each said first speaker driver means is angled toward said apex.

8. A sound focusing speaker system according to claim 7, wherein:

each said first speaker driver means is angled 30° to 60° relative to horizontal.

9. A sound focusing speaker system according to claim 7, wherein:

each said first speaker driver means is substantially aligned with said upper focus.

10. A sound focusing speaker system according to claim 9, wherein:

said second speaker driver means is located substantially at said lower focus and directed at said apex.

11. A sound focusing speaker system according to claim 6, wherein:

each said first speaker driver means has a center which is substantially positioned along an arc definable by said line segment.

12. A sound focusing speaker system according to claim 4, wherein:

said upper and lower parabolic portions meet at a step portion of said sound lens, said step portion defining a plane extending substantially through said upper focus.

13. A sound focusing speaker system according to claim 1, further comprising:

d) a crossover means for sending a first portion of an audio signal within said first frequency range to said at least one first speaker driver means and sending a second portion of the audio signal within said second frequency range to said second speaker driver means.

14. A sound focusing speaker system according to claim 1, wherein:

said at least one first speaker driver means is exactly two first speaker driver means.

15. A sound focusing speaker system according to claim 14, wherein:

said concave lens has an apex and each of said first speaker driver means is angled toward said apex.

16. A sound focusing speaker system according to claim 14, further comprising:

d) a crossover means for sending a first portion of an audio signal within said first frequency range to said at least one first speaker driver means and sending a second portion of the audio signal within said second frequency range to said second speaker driver means.

17. A sound focusing speaker system according to claim 1, wherein:

said second speaker driver assembly includes a speaker enclosure having a front baffle and a concave rear wall, said second speaker driver means being seated in said baffle.

18. A sound focusing speaker system, comprising:

a) a concave dome-shaped sound lens defining a space and having an apex, an upper parabolic portion defined by a first parabolic equation and having an upper focus, and a lower parabolic portion defined by a second parabolic equation and having a lower focus different than said upper focus;

b) at least one first speaker driver means for emitting sound waves of a first frequency range into said sound lens;

c) a second speaker driver assembly having a second driver means for emitting sound waves of a second frequency range into said sound lens, said second frequency range being different than said first frequency range; and d) mechanical mounting means for mounting said at least one first speaker driver means relative to said second speaker driver assembly and said second speaker driver assembly relative to said sound lens, said first and second driver means being directed into said sound lens, and said first and second driver means being at least partially within said space defined by said sound lens.

19. A sound focusing speaker system according to claim 18, wherein:

said at least one first speaker driver means is exactly two first speaker driver means, each having a center, and each first speaker driver means being provided off-axis from a line segment from said apex to said upper focus, said center of each said first speaker driver means being substantially positioned along an arc definable by said line segment.

20. A sound focusing speaker system according to claim 19, wherein:

each said first speaker driver means is directed toward said apex.

21. A sound focusing speaker system according to claim 18, further comprising:

e) a crossover means for sending a first portion of an audio signal within said first frequency range to said at least one first speaker driver means and sending a second portion of the audio signal within said second frequency range to said second speaker driver means.

22. A speaker system, comprising:

a) at least two first driver means for emitting sound waves of a first frequency range;

b) a second driver means for emitting sound waves of a second frequency range relatively lower than said first frequency range;

c) crossover means for sending a first portion of an audio signal within said first frequency range to said at least two first speaker driver means and sending a second portion of the audio signal within said second frequency range to said second speaker driver means; and d) a dome-shaped sound lens to which said at least two first driver means and said second driver means are coupled, wherein each of said at least two first driver means and said second driver means is directed towards a point common.

23. A speaker system according to claim 22, further comprising:

e) a speaker enclosure discrete from said sound lens, said speaker enclosure having a front surface in which said second driver means is seated, wherein said two first driver means are mechanically coupled to said speaker enclosure.

24. A speaker system according to claim 23, wherein:

said speaker enclosure is provided with a concave rear surface.

25. A speaker system according to claim 22, wherein:

said at least two first driver means and said second driver means are directed into a closed portion of said sound lens.

26. A speaker system according to claim 22, wherein:

said point common is an apex of said dome-shaped sound lens.

* * * * *